US012349722B2

(12) United States Patent
Crowe et al.

(10) Patent No.: US 12,349,722 B2
(45) Date of Patent: Jul. 8, 2025

(54) SMOKING PRODUCT MAKING SYSTEM AND METHOD FOR PRODUCING A PLURALITY OF SMOKING PRODUCTS

(71) Applicant: Vuber Technologies, LLC, Seattle, WA (US)

(72) Inventors: David Crowe, Lake Forest Park, WA (US); Lawrence M. Perrigo, Seattle, WA (US)

(73) Assignees: Vuber Technologies, LLC, Seattle, WA (US); Logical, LLC, Seattle, WA (US)

( * ) Notice: Subject to any disclaimer, the term of this patent is extended or adjusted under 35 U.S.C. 154(b) by 741 days.

(21) Appl. No.: 17/206,721

(22) Filed: Mar. 19, 2021

(65) Prior Publication Data

US 2022/0295869 A1 Sep. 22, 2022

(51) Int. Cl.
*A24C 5/40* (2006.01)
*A24C 5/06* (2006.01)

(52) U.S. Cl.
CPC . *A24C 5/40* (2013.01); *A24C 5/06* (2013.01)

(58) Field of Classification Search
CPC .... A24C 5/40; A24C 5/06; A24C 5/54; A24C 5/44; A24C 5/12
See application file for complete search history.

(56) References Cited

U.S. PATENT DOCUMENTS

2012/0138075 A1* 6/2012 Jespersen et al. ..... A24F 15/12 131/331
2019/0320710 A1* 10/2019 Sirois et al. ..... A24C 5/54
2022/0175019 A1* 6/2022 Tuttle ..... A24D 1/18
2022/0395016 A1* 12/2022 Kauffman et al. ..... A24D 1/02
2023/0039557 A1* 2/2023 Veelo et al. ..... B02C 23/02

* cited by examiner

*Primary Examiner* — Dionne W. Mayes
(74) *Attorney, Agent, or Firm* — Gleam Law, PLLC; Neil Juneja

(57) ABSTRACT

Presented is a smoking product making system as well as methods for producing a plurality of smoking products. The smoking product making system comprises a receptacle configured to releasably hold pre rolled cones, a closure device configured for closing the top end of the pre rolled cones filled with smoking material, and an ejector device configured to push the bottom end of each pre rolled cone. The smoking product making system as well as method is capable of simultaneously producing a plurality of finished smoking products (such as cigarettes) with equal precision by enabling application of equal force for closing the top ends of the pre rolled cones.

16 Claims, 20 Drawing Sheets

SMOKING PRODUCT MAKING SYSTEM AND METHOD FOR PRODUCING A PLURALITY OF SMOKING PRODUCTS

TECHNICAL FIELD OF INVENTION

The present invention generally relates to smoking product making system and more particularly the present invention pertains to devices and methods for making a plurality of smoking products (e.g., cannabis joints, spliff and cigarettes) by closing the pre-rolled cones filled with smoking material.

BACKGROUND

Rolling papers are conventionally used for making smoking products such as cigarettes, joints and so on. The rolling papers generally are thin, rectangular and tissue-like paper and generally, an operator or similar personnel manually makes smoking products by dropping the smoking material such as tobacco, cannabis and so on onto the rolling paper and then the operator bundles the rolling paper in the desired shape. Then, the bundled rolling paper requires closure of ends such that the smoking material does not fall out. The smoking product so formed has a substantially cylindrical or conical shape having smoking material uniformly packed inside it.

Nowadays, pre rolled cones are trending in market as they are quick and easy to use even for beginners. The pre-rolled cones does not require high skill and precision as compared to rolling papers as the operator does not have to roll the pre rolled cones in the desired shape. The operator can simply insert the smoking material in the pre rolled cones, either manually or using techniques/machines conventionally known in the art and then close the pre rolled cones to ensure the smoking material does not fall out from the pre rolled cones. The closure of open ends of pre rolled cones is a manual and a time consuming task and further, proper closing of the open ends of pre rolled cones depend on the skill level of the operator. The force exerted by the operator for closing the pre rolled cones are not standardized for all pre rolled cones thereby increasing chances for improper closing of many pre rolled cones.

Many attempts to provide solutions to some of the problems discussed hereinabove may be found in the prior art, such as for example: US20120138075A1 discloses steps of preparing a cigarette or cigar with filter tip. As disclosed in the patent application, the final step for the preparation of cigarette requires twisting first end of cone to close open volume and keep tobacco filler material compacted. The cigar or cigarette is then ready to smoke with a filter tip at its second end.

However, twisting the open end of each pre rolled cone for closing each pre rolled cone is a manual and time consuming task. When making a large number of smoking products from pre rolled cones, time required for closing the open end of the pre rolled cone increases and also, lots of pre rolled cones are not properly closed leading to leaking or deterioration of the smoking material in the smoking product. Further, twisting the open end of each pre rolled cone one at a time requires manual effort by the operator. The method is greatly influenced by human factors, and operator must twist the open end of all the pre rolled cones with equal precision (force, method), which is difficult to achieve even for highly skilled workers/operators.

US20190320710A1 discloses a cone closure apparatus for production of smoking articles. The apparatus includes:

(a) a frame; and (b) at least one cone holder supported by the frame and extending along an axis. The cone holder has a lower grip surface for applying a rotational force about the axis to an outer surface of a lower filled portion of a cone received in the cone holder. The cone having an upper empty portion disposed above the lower filled portion and protruding clear of the lower grip surface to receive a counter-rotational force about the axis, in a direction opposite the rotational force. The closure apparatus further includes (c) a drive supported by the frame for applying at least one of the rotational force and the counter-rotational force to twist the upper empty portion closed when the drive is energized. However, twisting the open end of each pre rolled cone for closing each pre rolled cone is a time consuming task. Further, the prior art US20190320710A1 involves use of electrical components such as drives, thereby limiting the use of the cone closure apparatus in environments where electricity is readily available. Further, the electrical components will require proper maintenance/servicing, which would lead to increase in costs related to production of a smoking product.

Thus, in the light of the above-mentioned background art, it is evident that, there is a need for a device and method for simultaneously closing the open end of a plurality of pre rolled cones with equal precision that would be simple in terms of design and at the same time could overcome above discussed drawbacks.

BRIEF SUMMARY

Before the present systems and methods, enablement are described, it is to be understood that this application is not limited to the particular systems, and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

It is an object of the present invention to provide a smoking product making system as well as method capable of simultaneously producing a plurality of smoking products.

It is an object of the present invention to provide a closure device capable of closing a plurality of pre rolled cones simultaneously, wherein the closure device comprises a base plate having a plurality of raised projections.

It is an object of the present invention to provide a closure device capable of closing a plurality of pre rolled cones with equal precision by applying equal forces for closing a plurality of pre rolled cones.

It is another object of the present invention to provide a method for closing open end of pre rolled cones by using the closure device wherein the method involves bringing the closure device in contact with a plurality of pre rolled cones to simultaneously close open ends of plurality of pre rolled cones.

It is another object of the present invention to provide an ejector device which assists in simultaneous removal of the plurality of closed pre rolled cones, wherein the ejector device comprises an ejector plate having a plurality of raised projections.

Embodiments of the present invention disclose a smoking product making system as well as method for simultaneously producing a plurality of smoking products. The smoking product making system comprising: a receptacle comprising a plurality of holes, wherein each hole comprises a top opening and a bottom opening and each hole is configured to releasably hold a pre rolled cone wherein each pre rolled cone is at least partially filled with a smoking material and comprises a top end and a bottom end; a closure device comprising a base plate and a plurality of raised projections extending from the base plate, wherein each raised projection is configured to fold an extended portion of each pre rolled cone projecting outside the top opening of the hole; thereby closing the top end of each pre rolled cone. A predefined sequence of movements of the closure device relative to the receptacle simultaneously closes top ends of a plurality of pre rolled cones such that each raised projection folds an extended portion of a pre rolled cone projecting outside the top opening of the hole.

Embodiments of the present invention disclose an ejection devices as well as methods for at least partially ejecting a plurality of pre rolled cones having closed top ends from the receptacle.

In an embodiment, the plurality of holes formed in the receptacle is formed as a plurality of through holes, wherein each through hole extends from the top surface of the receptacle to the bottom surface of the receptacle. Each through hole comprises a top opening formed on a top surface and a bottom opening formed on a bottom surface of the receptacle. The ejector device comprises an ejector plate and a plurality of raised projections extending from the ejector plate, wherein each raised projection of the ejector plate is configured to push the bottom end of the pre rolled cone through the bottom opening of the receptacle.

In another embodiment, the ejection devices/methods could utilize other means/techniques to at least partially eject/remove a plurality of pre rolled cones having closed top ends from the receptacle. The means/techniques can include but not limited to inverting and/or shaking the receptacle, applying pressurized air/gas to remove pre rolled cones, using vacuum removal of pre rolled cones and so on.

In an embodiment, a pair of handles may be provided on the closure device to enable grasping by the hands of the operator for moving the closure device.

In another embodiment, the smoking product making system comprises a locking enclosure for removable interlocking with the second portion of the receptacle.

In another embodiment, the bottom end of each pre rolled cone includes a filter tip.

In another embodiment, the length of the plurality of raised projections of the ejector device is smaller than the length of the holes of the receptacle.

In another embodiment, the length of the plurality of raised projections of the ejector device is equal or larger than the length of the holes of the receptacle.

In another embodiment, the ejector device comprises a plurality of sidewalls extending from the peripheral edges of the ejector plate.

In another embodiment, the numbers of sidewalls are less or equal to the number of edges of the ejector plate of the ejector device.

Various objects, features, aspects and advantages of the present invention will become more apparent from the following detailed description of the embodiments of the invention, along with the accompanying drawings in which like numerals represent like components.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

The various features and embodiments of closure device and method of the present invention will now be described in conjunction with the accompanying figures, namely FIGS. 1-20.

Figure 1:
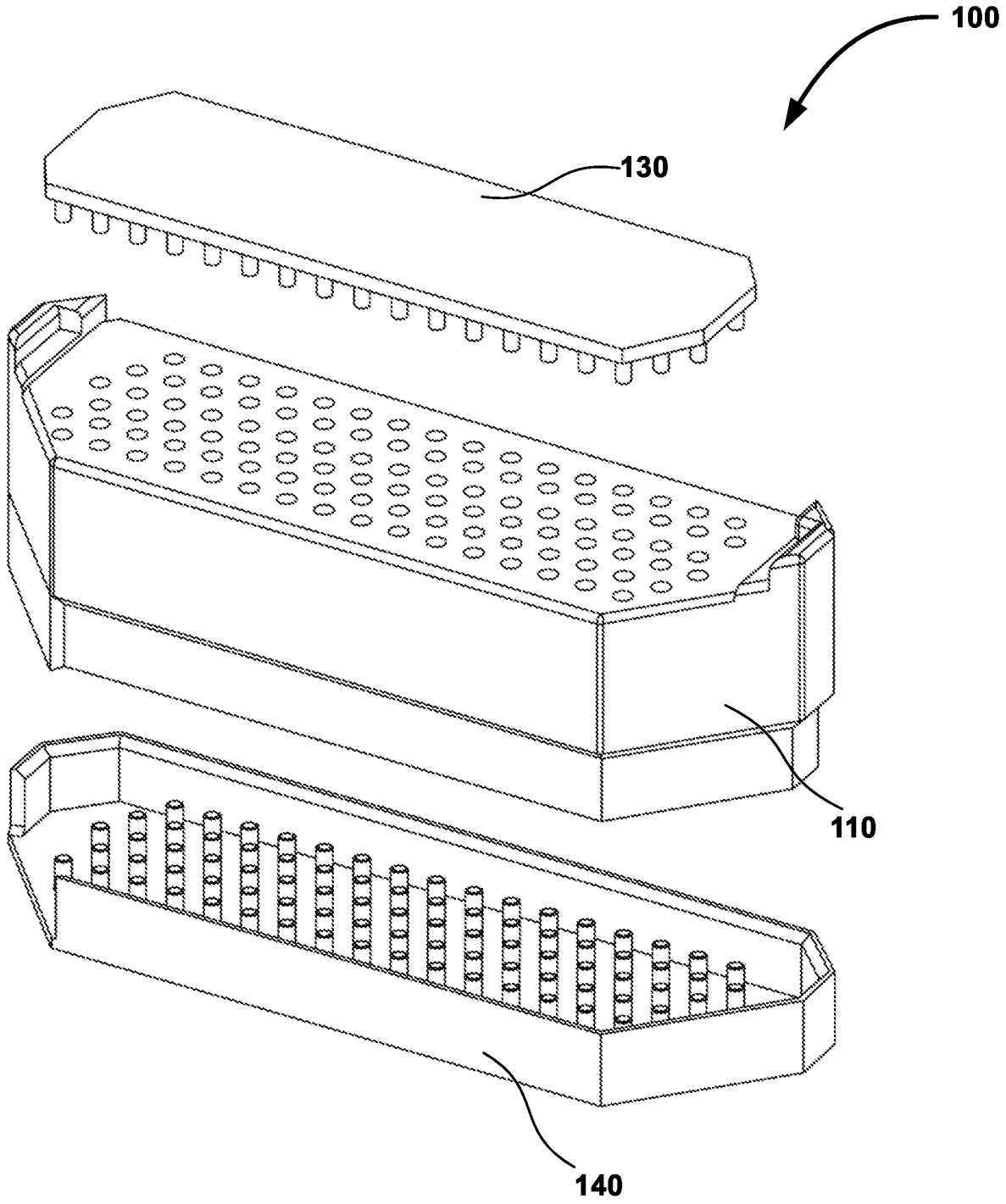
FIG. 1 illustrates a smoking product making system of the present invention, in accordance with various embodiments.
Figure 3:
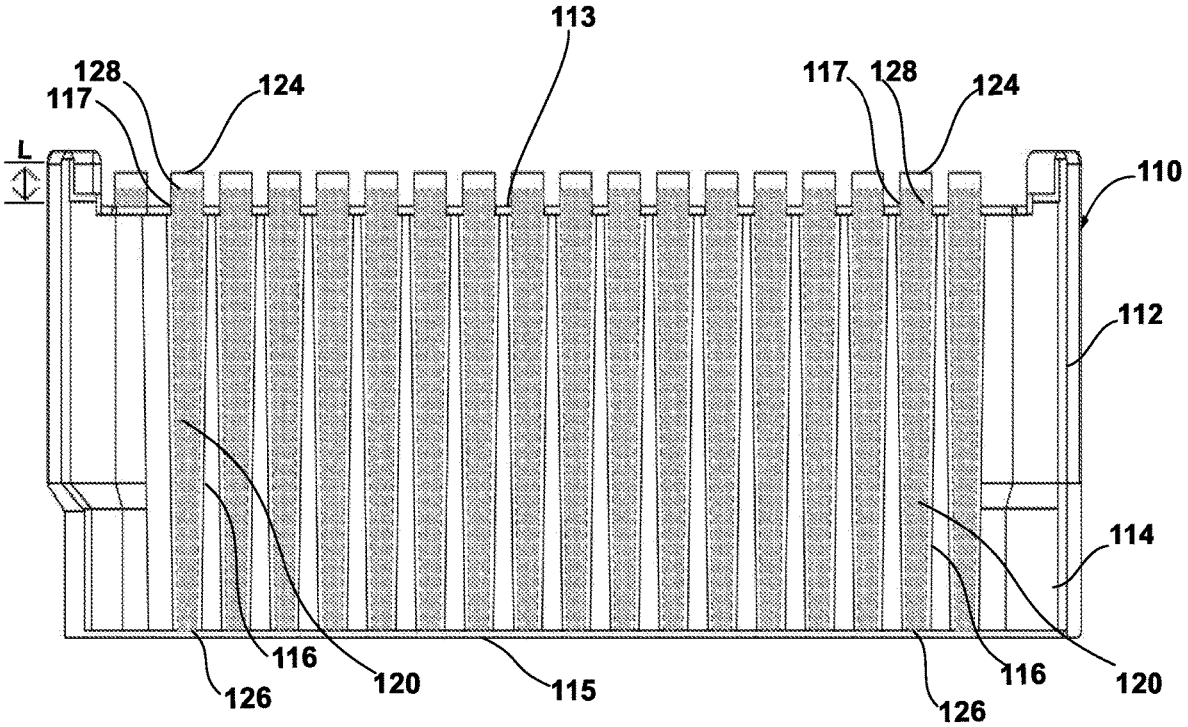
FIG. 3 illustrates a sectional view of a receptacle holding a plurality of pre rolled cones having an extended portion with an open top end projecting outside the top surface of the receptacle, according to an embodiment of the present invention.

Referring to accompanying figures, especially FIG. 1, a smoking product making system 100 is shown capable of simultaneously producing a plurality of smoking products, in accordance with various embodiments of present invention. As shown in FIG. 3, the plurality of smoking products (e.g., cannabis joints, spliff and cigarettes) are produced by closing the plurality of pre-rolled cones 120 wherein each pre-rolled cone 120 is at least partially filled with smoking material. Each pre-rolled cone 120 further comprises a top end 124 and a bottom end 126, the entirety of which will be described in greater detail in the description to follow.

Figure 2A:
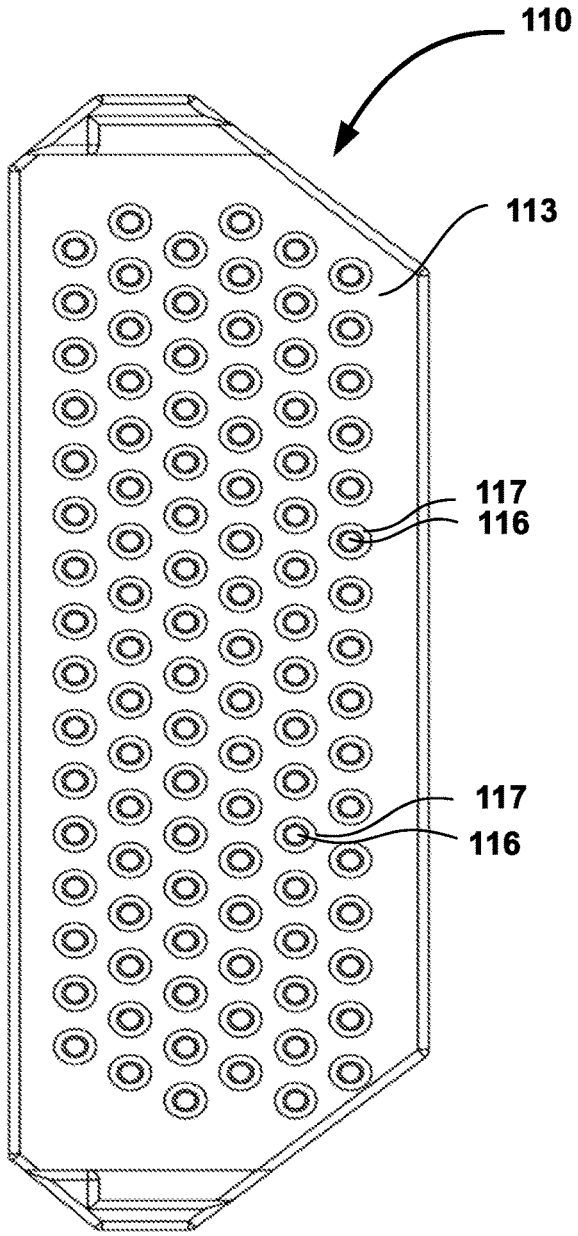
FIG. 2A and FIG. 2B illustrates a top view and a bottom view of a receptacle respectively, according to an embodiment of the present invention.
Figure 2B:
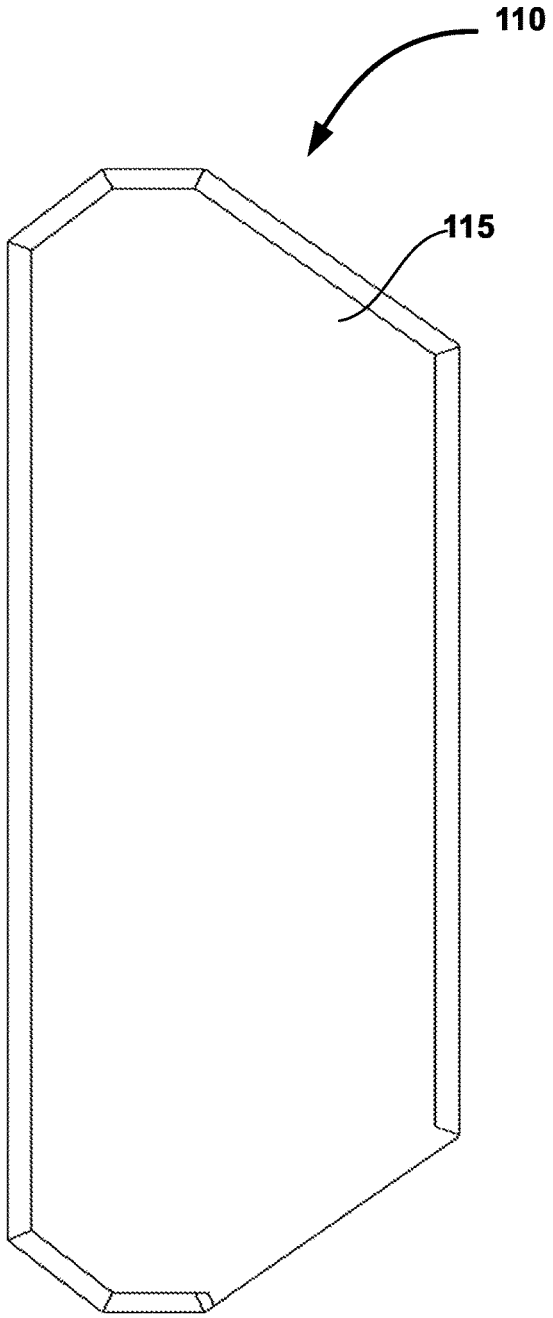

According to an embodiment as shown in FIG. 2A, FIG. 2B and FIG. 3, the smoking product making system 100 comprises a receptacle 110 configured to releasably hold the plurality of pre rolled cones 120, the entirety of which will be described in greater detail in the below description.

Figure 4A:
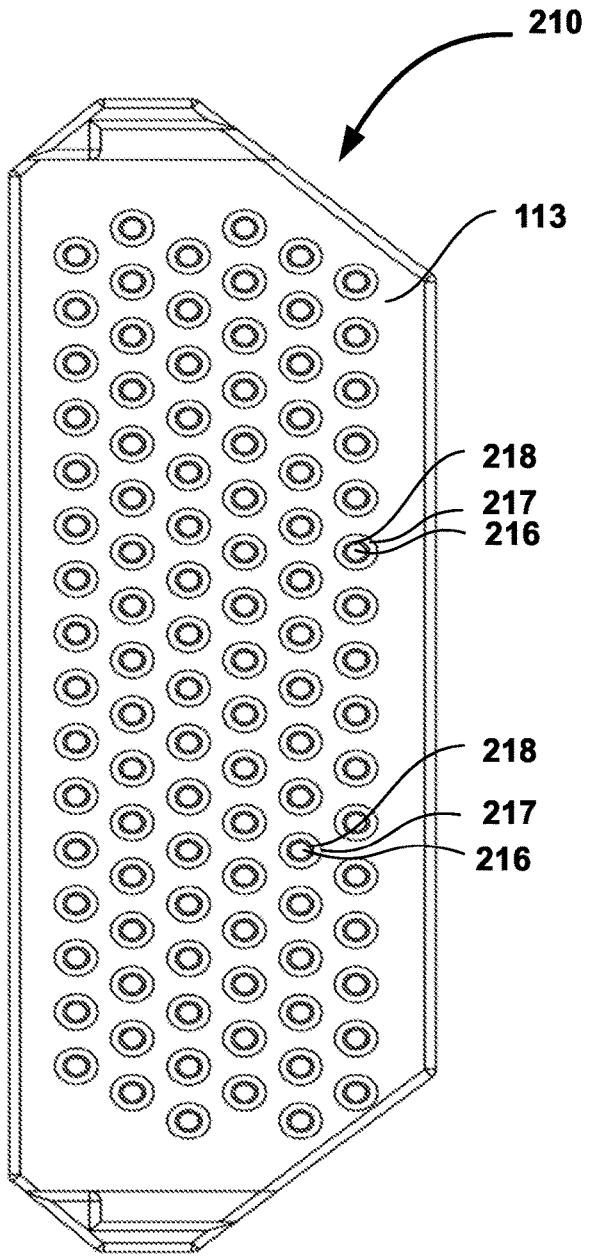
FIG. 4A and FIG. 4B illustrates a top view and a bottom view of a receptacle respectively, according to another embodiment of the present invention.
Figure 4B:
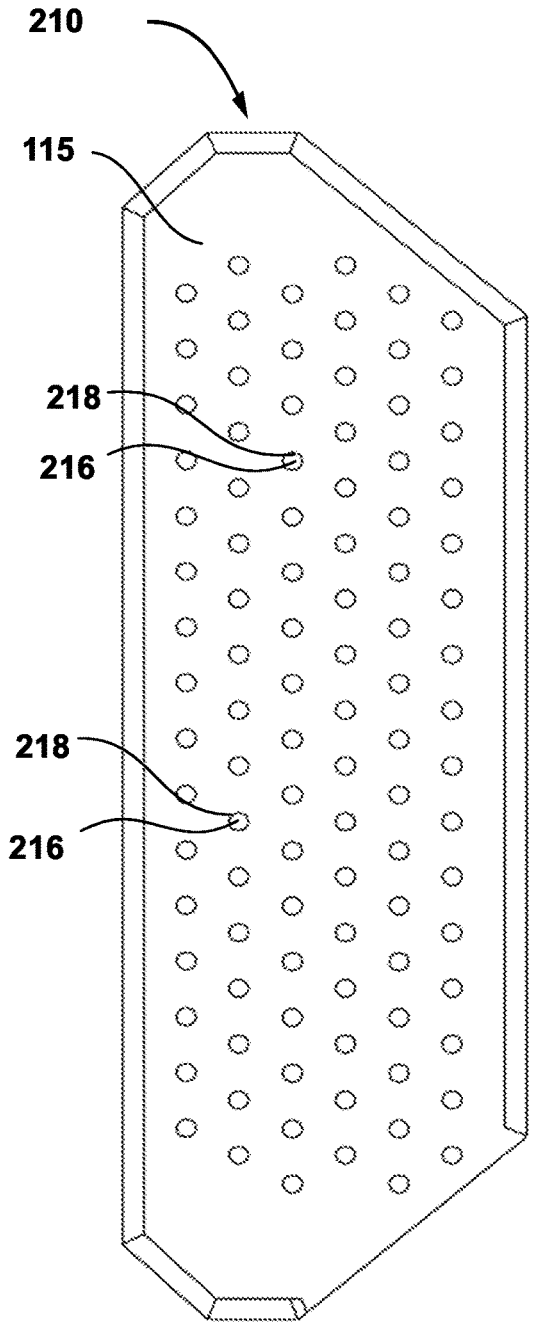
Figure 5:
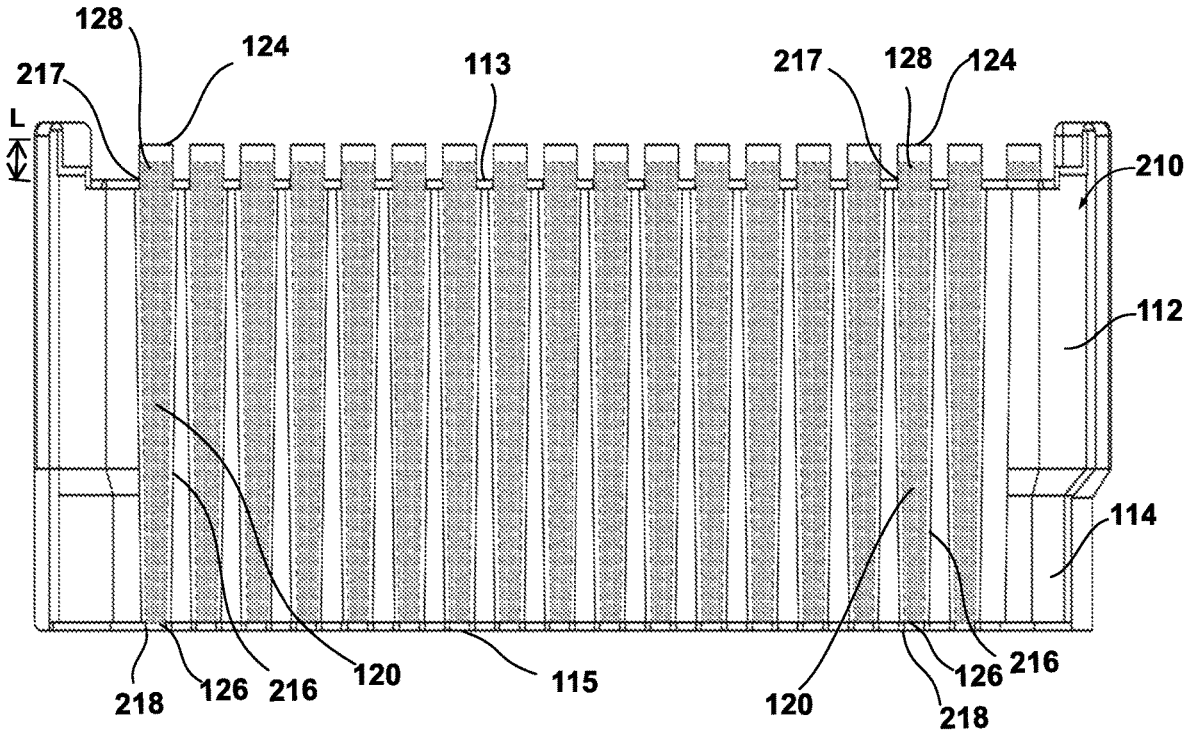
FIG. 5 illustrates a sectional view of a receptacle holding a plurality of pre rolled cones having an extended portion with an open top end projecting outside the top surface of the receptacle, according to another embodiment of the present invention.

According to another embodiment as shown in FIG. 4A, FIG. 4B and FIG. 5, the smoking product making system 100 comprises a receptacle 210 configured to releasably hold the plurality of pre rolled cones 120, the entirety of which will be described in greater detail in the below description.

According to various embodiments as shown in FIGS. 6-12, further, the smoking product making system 100 comprises a closure device 130 configured for closing the top end 124 of a plurality of pre rolled cones 120, the entirety of which will be described in greater detail in the below description.

Figure 15:
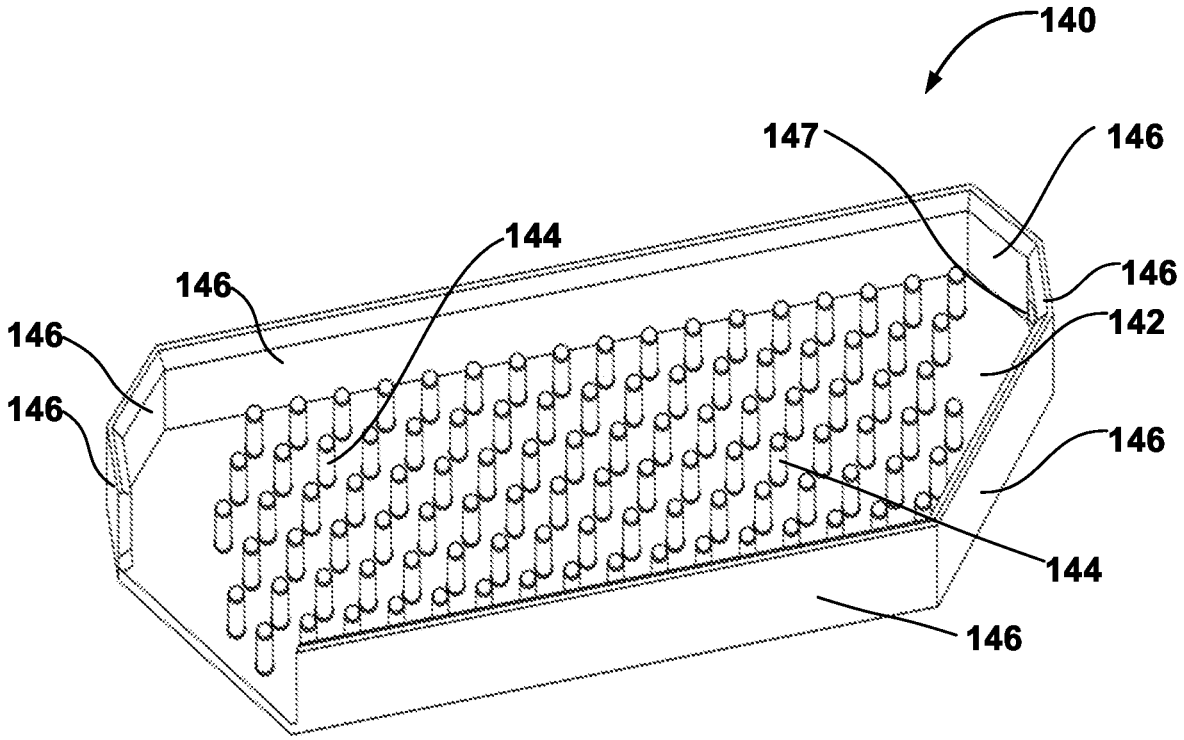
FIG. 15 illustrates a perspective view of an ejector device, according to an embodiment of the present invention.
Figure 16:
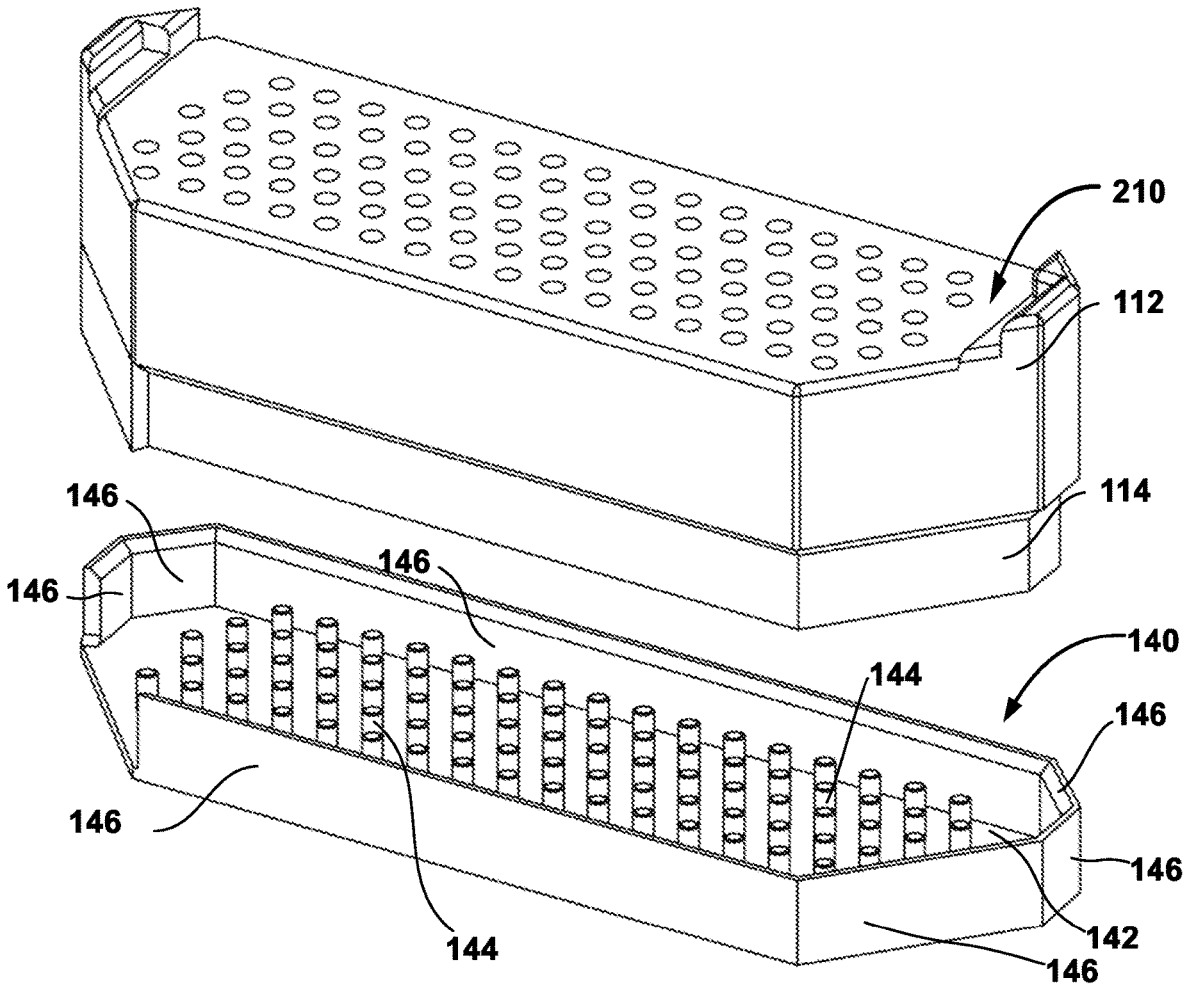
FIG. 16 illustrates a perspective view of an ejector device aligned with the receptacle of FIGS. 4A-4B, according to an embodiment of the present invention.
Figure 17:
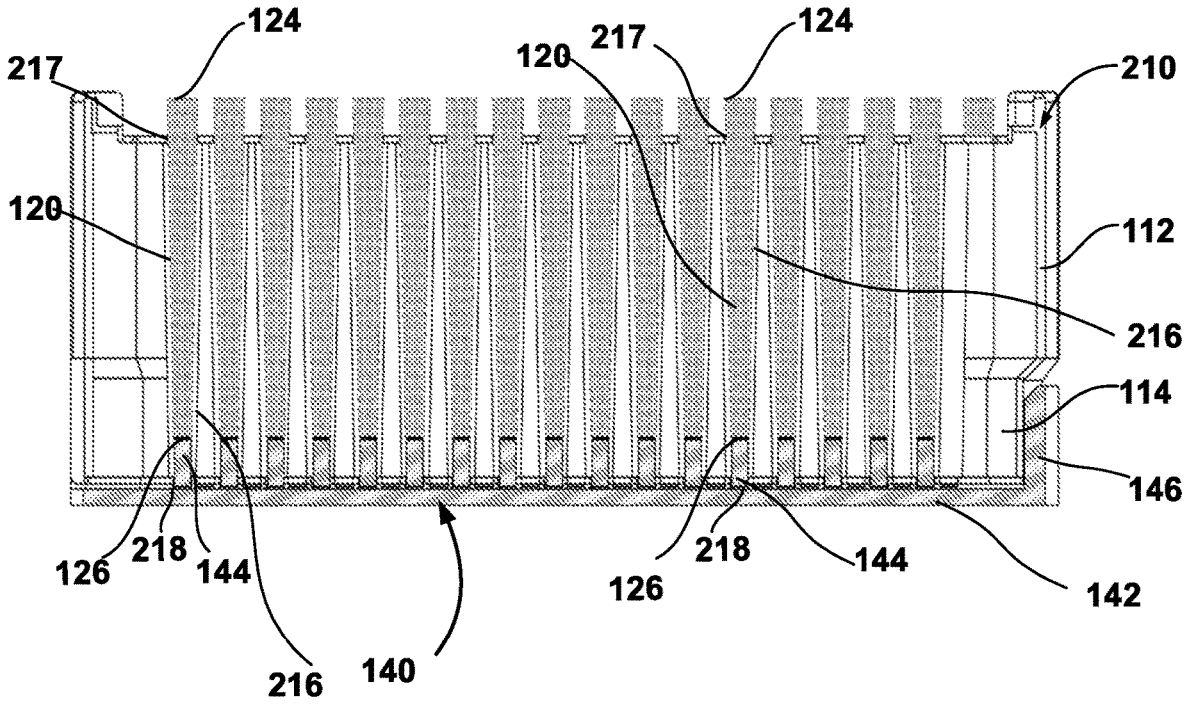
FIG. 17 illustrates a sectional view of an ejector device removably connected to the receptacle of FIGS. 4A-4B, according to an embodiment of the present invention.

According to an embodiment as shown in FIGS. 15-17, Further, the smoking product making system 100 comprises an ejector device 140 configured to push the bottom end 126 of the plurality of pre rolled cones 120, the entirety of which will be described in greater detail in the below description.

Referring to accompanying figures, especially FIG. 2A and FIG. 2B that shows a top perspective view and a bottom view of the receptacle 110 respectively, according to an embodiment of the present invention. In an embodiment as shown in FIG. 2A, the receptacle 110 is a substantially trapezoid shaped body as seen from top view. Further, in another embodiment, other shapes for the receptacle 110 can include but not limited to rectangular shape, circular shape, and square shape and so on. Further, the receptacle 110 comprises a first portion 112 and a second portion 114 as shown in FIG. 3. The first portion 112 has a larger cross sectional area than the second portion 114. The first portion 112 includes a top surface 113 and the second portion 114 includes a bottom surface 115. As seen, the receptacle 110 comprises a plurality of holes 116 extending through the top surface 113 of the first portion 112. As seen in FIG. 1, the holes 116 are formed in the receptacle 110 in an array pattern. In alternative embodiments, the holes 116 can be formed in the receptacle 110 in various forms/patterns such as but not limited to linear pattern, circular pattern and so on. Each hole 116 have a substantially conical shape and each hole 116 is adapted to hold a pre rolled cone 120 as seen in FIG. 3. Further each hole 116 comprises a top opening 117 formed on a top surface 113 of the receptacle 110.

Referring to FIG. 3 that shows sectional side view of the receptacle 110, according to an embodiment of the present invention. As seen, the receptacle 110 is capable of holding the plurality of pre rolled cones 120 in the plurality of holes 116. Each pre rolled cone 120 is at least partially filled with a smoking material such as but not limited to tobacco, marijuana and/or combinations thereof. Each pre rolled cone 120 comprises a top end 124, and a bottom end 126. Both the top end 124 as well as the bottom end 126 has substantially circular shape and the top end 124 has a larger cross sectional area than the bottom end 126. The top end 124 of each pre rolled cone 120 is open so that the smoking material can be inserted/removed from the pre rolled cone 120 through the top end 124. The cross sectional area of the bottom end 126 of each pre rolled cone 120 is configured such that the pre rolled cone 120 and/or smoking material is not expelled out from the bottom opening 118 of the receptacle 110. In another embodiment (not shown), the bottom end 126 of each pre rolled cone 120 could include a filter tip which would not allow expulsion of the smoking material from the bottom end 126. As seen, each pre rolled cone 120 is inserted into the hole 116 of the receptacle 110 and an extended portion 128 of length L of each pre rolled cone 120 projects outside the top opening 117 of a hole 116.

Referring to FIG. 4A, FIG. 4B and FIG. 5 that shows a top view, bottom view and sectional side view of the receptacle 210 respectively, according to another embodiment of the present invention. The receptacle 210 is similar to the receptacle 110 except for the modification(s) that the receptacle 210 comprises a plurality of through holes 216 extending from the top surface 113 of the first portion 112 to the bottom surface 115 of the second portion 114. Further each through hole 216 comprises a top opening 217 formed on a top surface 113 and a bottom opening 218 formed on a bottom surface 115 of the receptacle 210. The cross sectional area of the bottom end 126 of each pre rolled cone 120 is equal or smaller than the bottom opening 218 of the receptacle 210 such that the pre rolled cone 120 and/or smoking material doesn't get not expelled out from the bottom opening 218 of the receptacle 110. The receptacle 210 is placed on a rigid support surface (for e.g. ground surface, table surface) during operative use of the closure device 130 (FIG. 6) along with the receptacle 110.

Figure 6:
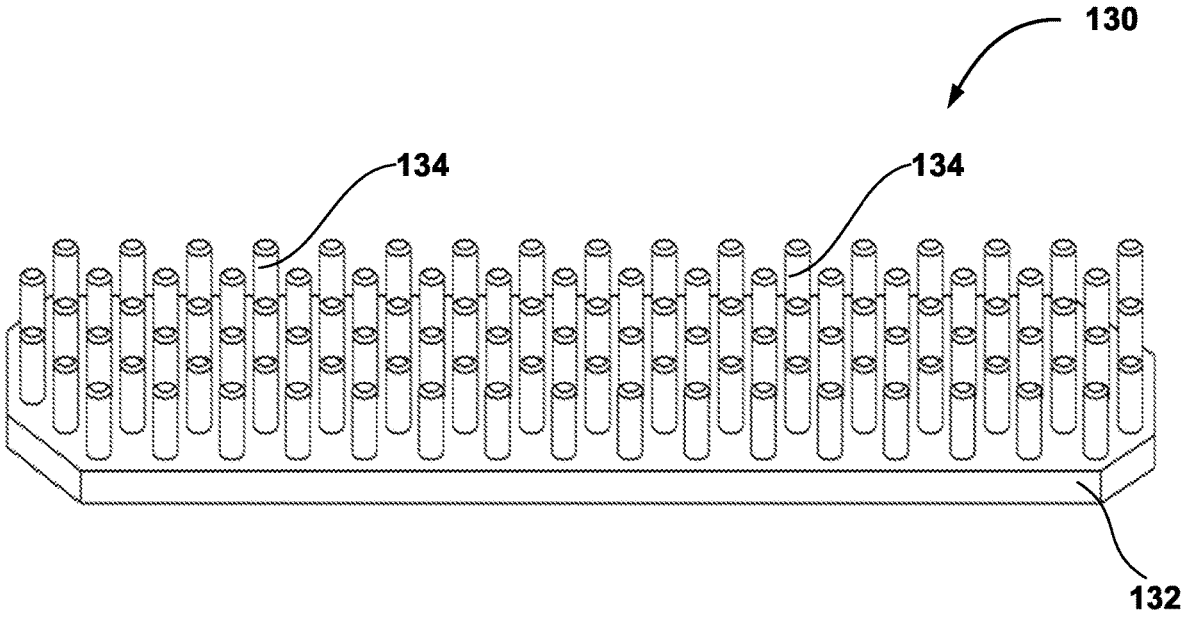
FIG. 6 illustrates a perspective view of a closure device, according to an embodiment of the present invention.

Referring to FIG. 6 that shows a perspective view of the closure device 130, according to an embodiment of the present invention. As seen, the closure device 130 comprises a base plate 132 and a plurality of raised projections 134. The plurality of raised projections 134 extend from the base plate 132. Each raised projection 134 have a tip of any shape including but not limited to hemispherical shape, flat shape, conical shape and so on and each raised projection 134 can have any shape including but not limited to cylindrical, conical shape, polygonal shape and so.

Figure 7:
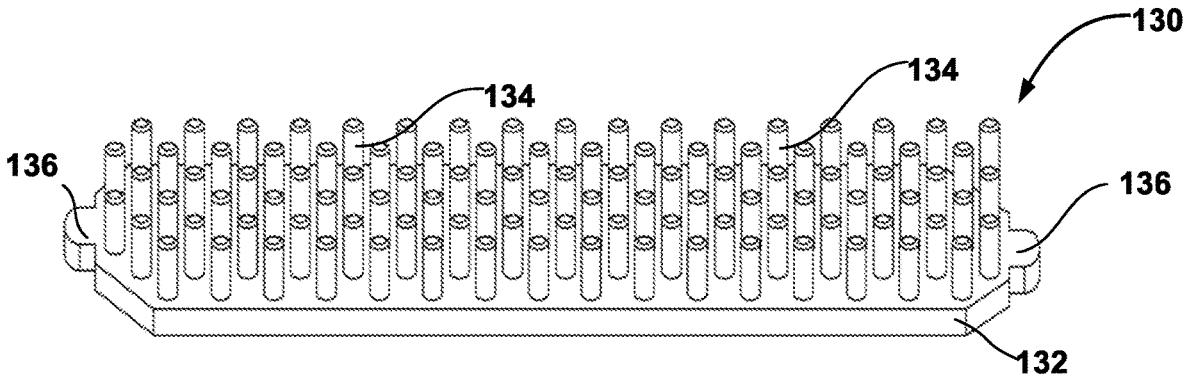
FIG. 7 illustrates a perspective view of a closure device, according to another embodiment of the present invention.

In another embodiment, as shown in FIG. 7, the base plate 132 of the closure device 130 may include a pair of handles 136 to be grasped by the operator or similar personnel for moving the closure device 130.

In another embodiment, the cross sectional area of each raised projection 134 is selected such that the raised projection 134 is form fit (close fit) with the extended portion 128 of a pre rolled cone 120 when the closure device 130 is pushed against the plurality of pre rolled cones 120 present/disposed within the plurality of holes 116 of the receptacle 110 (as shown in FIG. 3).

In another embodiment, the cross sectional area of each raised projection 134 is selected such that the plurality of raised projections 134 compresses the smoking material filled in the plurality of pre rolled cones 120 when the closure device 130 is pushed against the plurality of pre rolled cones 120 disposed within the plurality of holes 116 of the receptacle 110 (as shown in FIG. 3). This compression of the smoking material makes an empty unfilled space in the extended portion 128 of the plurality of pre rolled cones 120.

Referring to FIGS. 8-12 along with FIG. 3, a method for closing the top end 124 of the plurality of pre rolled cones 120 disposed/present in the receptacle 110 by using the closure device 130 is shown. As seen, the extended portion 128 of the plurality of pre rolled cones 120 (as shown in FIG. 3) projects outside the top opening 117 of the holes 116. The closure device 130 is moved relative to the receptacle 110 such that the closure device 130 simultaneously closes the top end 124 of the plurality of pre rolled cones 120 using a predefined sequence of movements of the closure device 130. The receptacle 110 is placed on a rigid support surface (for e.g. ground surface, table surface) during operative use of the closure device 130 along with the receptacle 110. The predefined sequence of movements of the closure device 130 relative to the receptacle 110 to simultaneously closes top ends 124 of a plurality of pre rolled cones 120 will be described in greater detail in the description below.

Figure 8:
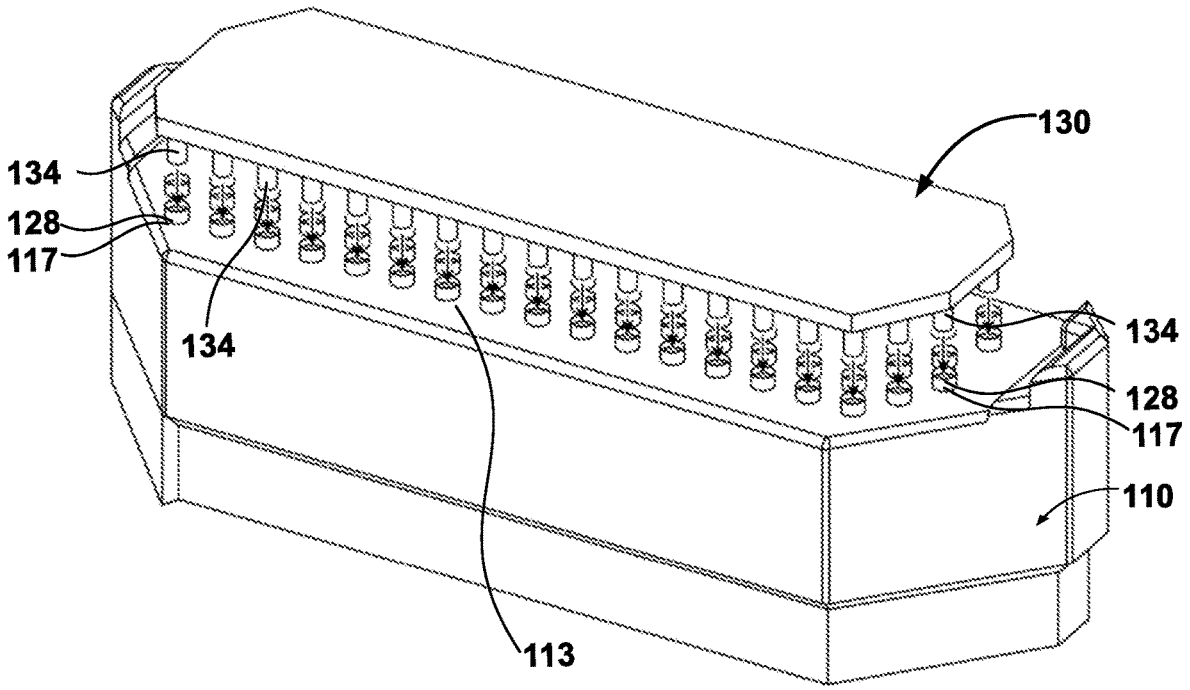
FIGS. 8-12 illustrates various steps of an exemplary method to close the top end of the plurality of pre rolled cones by using the closure device of FIG. 6, in accordance with various embodiments of the present invention.
Figure 9:
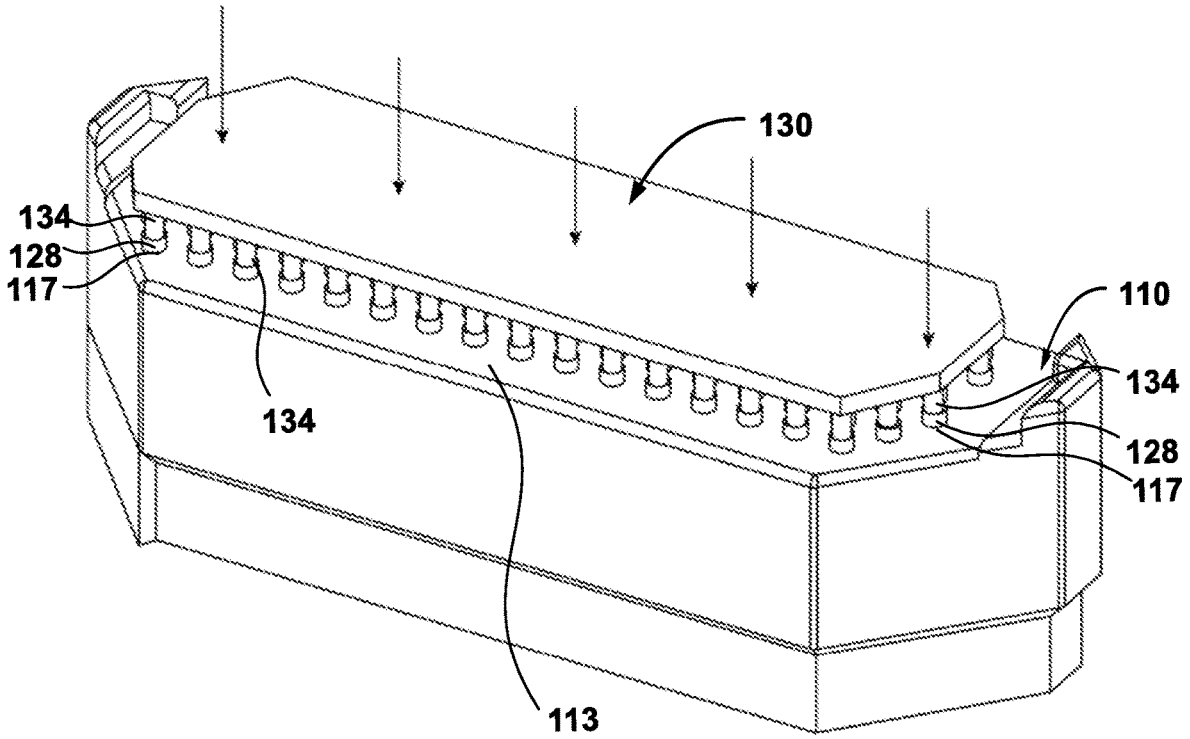

Referring to FIG. 8, firstly the closure device 130 is brought in alignment relative to the receptacle 110 such that each raised projection 134 of the closure device 130 is coaxial relative to extended portion 128 of the pre rolled cone 120. Then, the closure device 130 is moved/pushed towards the receptacle 110 (as seen in FIG. 9) in a direction substantially perpendicular to the top surface 113 such that each raised projection 134 of the closure device 130 applies a downward force towards the receptacle 110 as shown by the arrows in FIG. 9.

In an embodiment, the downward force exerted by the plurality of raised projections 134 compresses the smoking material (as seen in FIG. 3) filled in the plurality of pre rolled cones 120. The top end 124 of the plurality of pre rolled cones 120 are open such that each raised projection 134 enters the open end 120 thereby compressing the smoking material filled in a pre rolled cone 120 and producing an empty unfilled space in the extended portion 128 of a pre rolled cone 120. The hollow extended portion 128 so formed is folded down in steps described below in greater detail.

In another embodiment, the downward force exerted by the raised projections 134 results in tamping of the extended portion 128 of the pre rolled cones 120. The tamping of the extended portion 128 reduces the length L (as shown in FIG. 3) of the extended portion 128 by partially folding and/or pushing the extended portion 128 towards the receptacle 110. The extended portion now projecting outside the top opening 117 of the holes 116 has an overall length L' (not shown in figures) wherein the magnitude of length L' is smaller than L.

Figure 10:
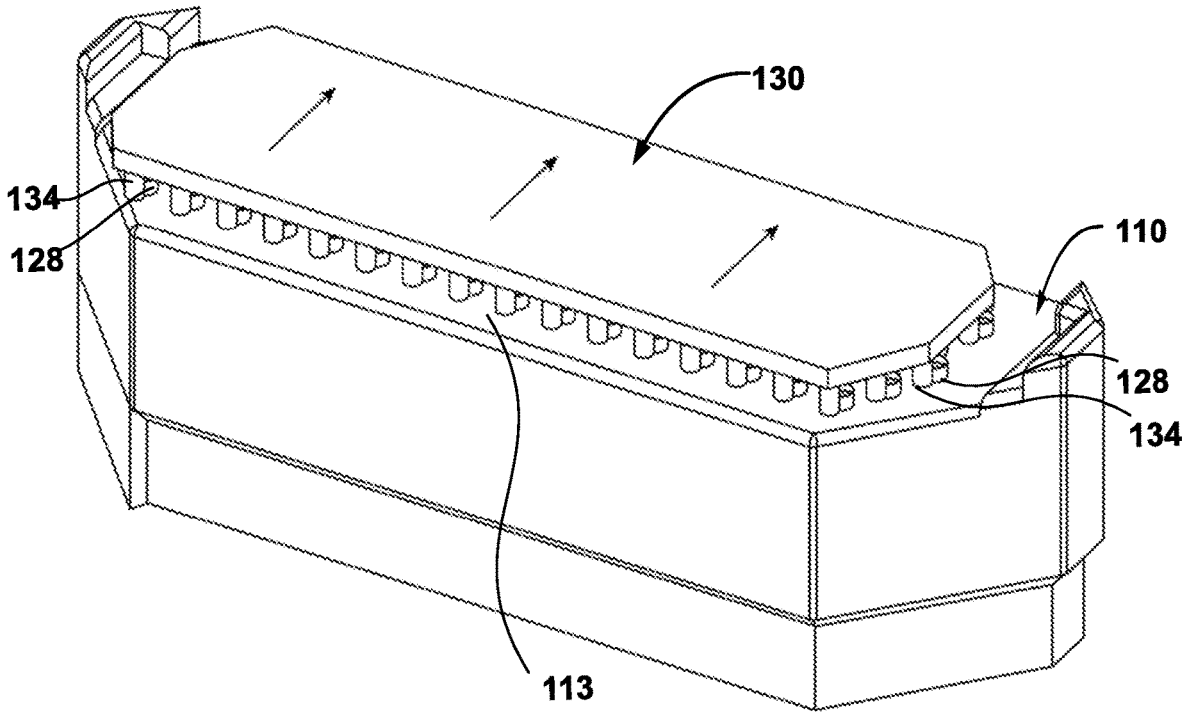

Afterwards, the closure device 130 is moved/pulled away from the receptacle 110 and then the closure device 130 is moved in a horizontal plane substantially parallel to the top surface 113 in a specific direction as shown in FIG. 10 such that each raised projection 134 applies a radially inward force towards the extended portion 128 of the pre rolled cone 120. The extended portion 128 has a substantially cylindrical shape and the radially inward force exerted by each raised projection 134 towards the extended portion 128 in a specific direction as shown by the arrows in FIG. 10 folds a specific portion (for e.g. an arc, a quadrant) of the extended portion 128, thereby forming an arcuate fold in the extended portion 128.

In another embodiment, the inward radial movements of each raised projection 134 relative to the receptacle 110 may be followed by moving/pushing the closure device 130 towards the receptacle 110 in a direction substantially perpendicular to the top surface 113 to further fold down the specific portion and/or compress the smoking material to form a hollow extended portion 128 using similar method as shown in FIG. 9.

Figure 11:
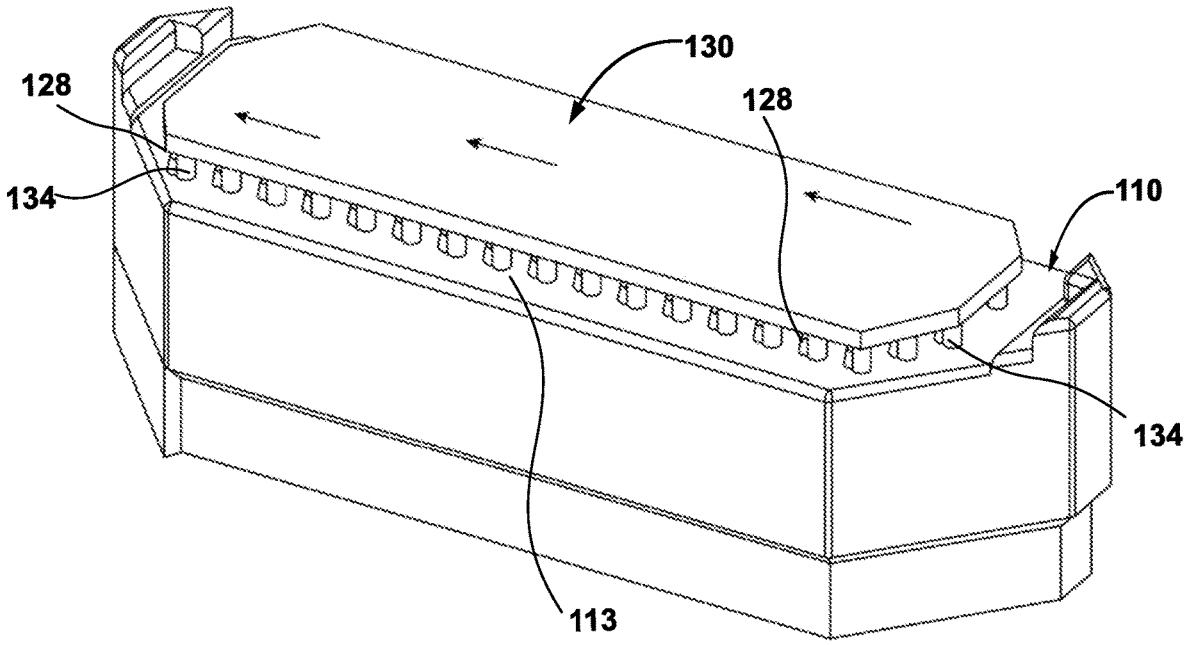

Afterwards, the closure device 130 is moved/pulled away from receptacle 110 and then the closure device 130 is moved in a horizontal plane in an another direction substantially parallel to top surface 113 as shown in FIG. 11 such that each raised projection 134 applies a radially inward force towards the extended portion 128 of the pre rolled cone 120. The extended portion 128 has a substantial cylindrical shape and the radially inward force exerted by a raised projection 134 towards the extended portion 128 in another direction as shown by the arrows in FIG. 11 folds another portion (for e.g. an arc, a quadrant) of the extended portion 128, thereby forming another arcuate fold in the extended portion 128 of a pre rolled cone 120.

In another embodiment, the inward radial movement of each raised projection 134 may be followed by moving/pushing the closure device 130 towards the receptacle 110 in a direction substantially perpendicular to top surface 113 to further fold down the another portion and/or compress the smoking material to form a hollow extended portion 128 using similar method as shown in FIG. 9.

Figure 12:
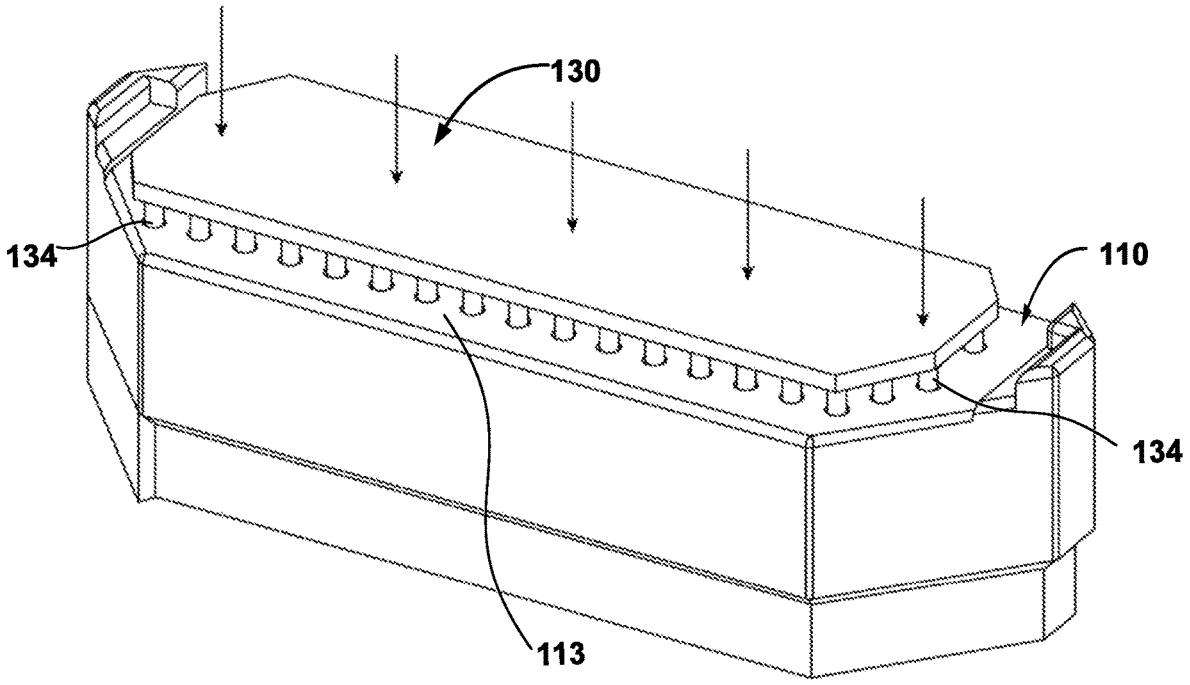
Figure 13:
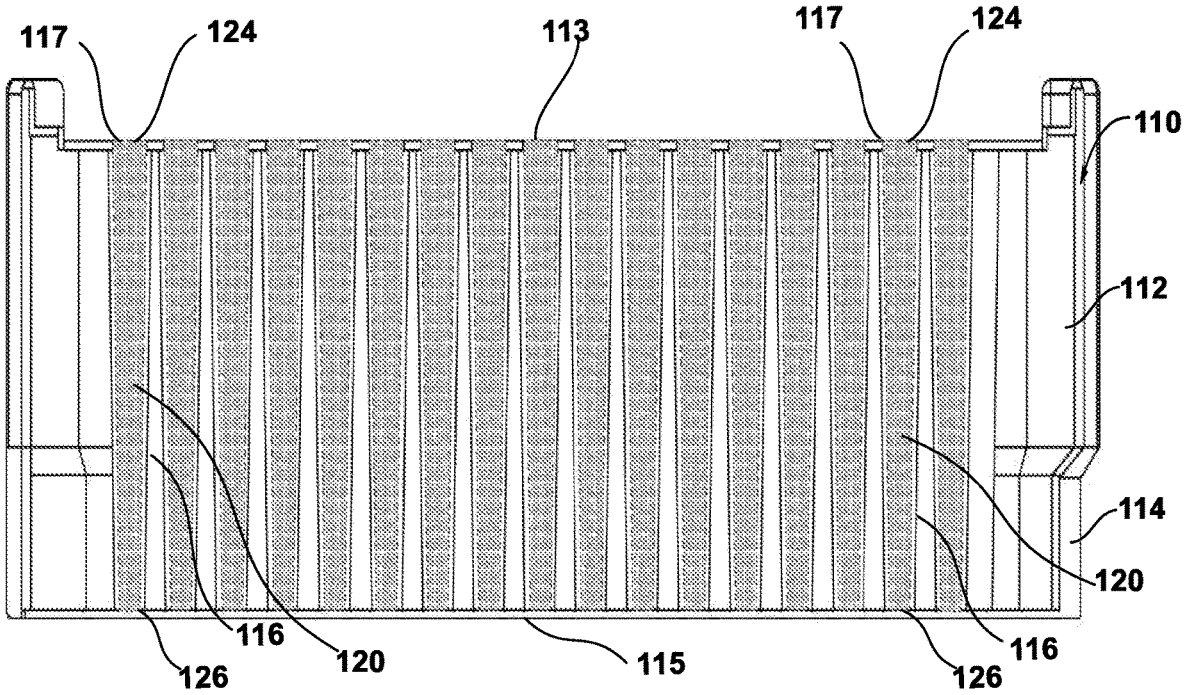
FIG. 13 illustrates a sectional view of the receptacle holding the plurality of pre rolled cones having a closed top end, according to an embodiment of the present invention.

By repeating steps of radially moving each raised projection 134 of the closure device 130 towards the extended portion from multiple directions and optionally followed by moving/pushing the closure device 130 in a direction substantially perpendicular to top surface 113 towards the receptacle (as shown in FIG. 9) as depicted in above embodiments a number of times, the closure device 130 can be used to fold multiple portions of the extended portion 128, eventually closing the top end 124 so that the length of the extended portion 128 is substantially zero (as can be seen in FIG. 12 and FIG. 13). As shown in FIG. 12, each raised projection 134 of the closure device 130 pushes the folded multiple portions of the extended portion 128 towards the hole 116 to eventually close the top end 124 of a pre rolled cone 120. The number of times, the steps of radially moving the raised projection 134 of the closure device 130 in a direction towards the extended portion optionally followed by moving/pushing the closure device 130 in a direction substantially perpendicular to top surface 113 towards the receptacle 110 are repeated, is a natural number more than one. The operator can repeat steps multiple times to avoid "cat ears", which are small projections caused by folds having too large of an angular spacing between two adjacent folds. Cat ears are avoided by folding at sufficiently close angular spacing between folds which can be done by folding from multiple directions. As shown in FIG. 13, the top end 124 of a plurality of pre rolled cones 120 is closed and no extended portion projects outside the top opening 117 of the hole 116 that is the length of the extended portion 128 is substantially zero.

The rigid support surface supports movement of the closure device 130 relative to the receptacle 110 as it is capable of withstanding forces exerted by the closure device 130 on the receptacle 110. The receptacle 110 is placed on the rigid support surface during closing of the top end 124 of the pre rolled cones 120.

In an embodiment, the rigid support surface includes a ground surface including but not limited to table top, machine top, floor surface and so on.

Figure 14:
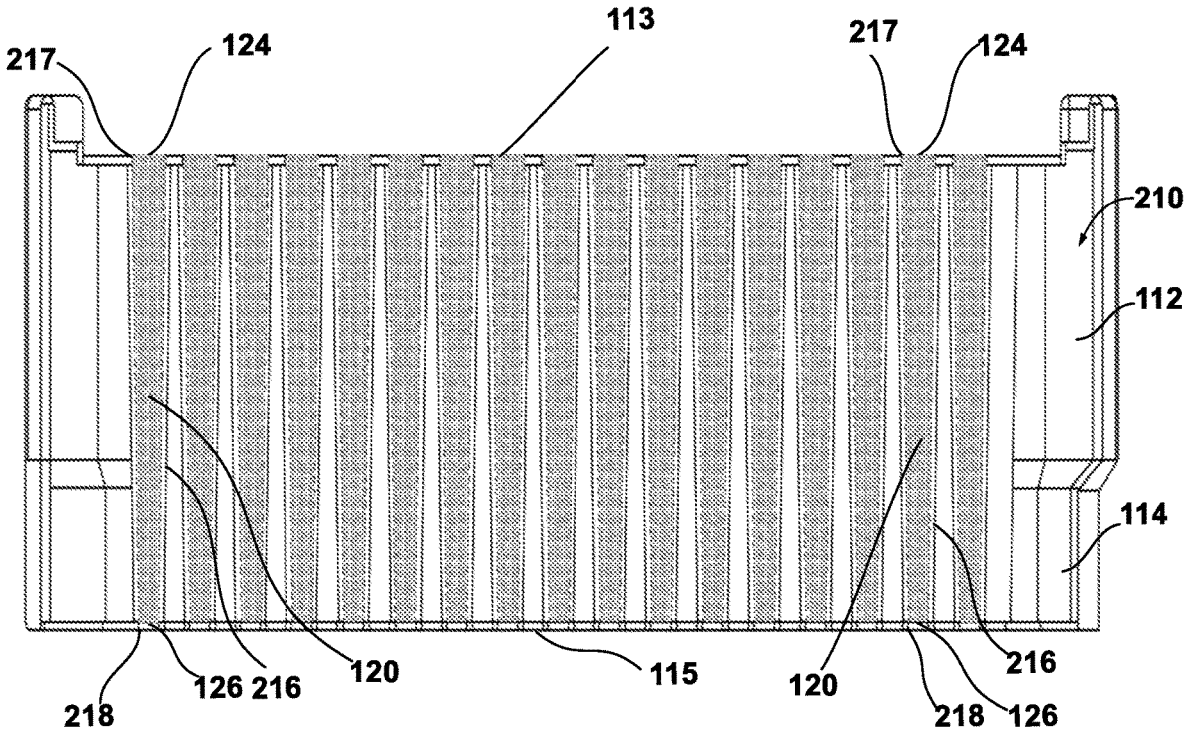
FIG. 14 illustrates a sectional view of the receptacle holding the plurality of pre rolled cones having a closed top end, according to another embodiment of the present invention.

Referring to FIGS. 8-12 along with FIG. 3, a method for closing the top end 124 of the plurality of pre rolled cones 120 disposed/present in the receptacle 110 by using the closure device 130 is shown. In this method as shown in FIGS. 8-12, the receptacle 110 comprising a plurality of holes 116 is considered for sake of simplicity. However, it is obvious to the one skilled in the art that similar method could be used for closing the top end 124 of the plurality of pre rolled cones 120 disposed/present in the receptacle 210 (as can be seen in FIG. 4A, FIG. 4B and FIG. 5) by using the closure device 130 with little or no variation. As shown in FIG. 14, the top end 124 of a plurality of pre rolled cones 120 present/disposed in the receptacle 210 is closed and no extended portion projects outside the top opening 217 of the through hole 216 of the receptacle 210 making the length of the extended portion 128 substantially zero.

The rigid support surface supports movement of the closure device 130 relative to the receptacle 210 as it is capable of withstanding forces exerted by the closure device 130 on the receptacle 210. The receptacle 210 is placed on the rigid support surface during closing of the top end 124 of the pre rolled cones 120. Further, the rigid support surface prevents expulsion of the smoking material and/or pre rolled cone 120 from the bottom opening 218 of the plurality of through holes 216 of the receptacle 210.

In an embodiment, the rigid support surface includes a ground surface including but not limited to table top, machine top, floor surface and so on.

In another embodiment, the rigid support surface comprises a locking enclosure that is placed on a ground surface. The locking enclosure is configured to removably interlock with the second portion 114 of the receptacle 210 (as can be seen in FIG. 4A, FIG. 4B and FIG. 5) to prevent expulsion of the smoking material and/or pre rolled cones 120 from the through holes 216 of the receptacle 210. The interlocking of the locking enclosure could be done using any conventional methods including but not limited to friction locking, magnetic locking, male female arrangements, snap fits, clamping arrangement and so on. The locking enclosure is configured to accommodate the bottom surface 115 of the receptacle 210 such that it prevents expulsion of smoking material and/or pre rolled cone 120 from the bottom opening 218 of the through hole 216 of the receptacle 210.

Various ejection devices as well as methods for at least partially ejecting a plurality of pre rolled cones 120 having closed top ends 124 from the receptacle (110, 210) will now be described.

In an embodiment, the ejection devices/methods could utilize other means/techniques to at least partially eject/remove a plurality of pre rolled cones 120 having closed top ends 124 from the receptacle (110, 210). The means/techniques can include but not limited to inverting and/or shaking the receptacle, applying pressurized air/gas to remove pre rolled cones, using vacuum removal of pre rolled cones and so on.

Referring to FIG. 15 that shows a perspective view of an ejector device 140 according to an embodiment of the present invention. As seen, the ejector device 140 comprises an ejector plate 142. The ejector plate 142 is substantially trapezium shaped. A plurality of raised projections 144 extends from the ejector plate 142. Each raised projection 144 have a tip of a shape including but not limited to flat shape, hemispherical shape, conical shape and so on and each raised projection 144 can have a shape including but not limited to cylindrical, conical shape and so on.

In an embodiment, a plurality of sidewalls 146 extends from the peripheral edges of the ejector plate 142. The sidewalls 146 acts as a guide member such that when the receptacle 210 (as can be seen in FIG. 4A, FIG. 4B and FIG. 5) is placed on the ejector device 140, the sidewalls 146 assists in proper connection of the ejector device 140 and the receptacle 210. The number (Ns) of sidewalls 146 are set less or equal to the number (Ne) of edges of the ejector plate 142 of the ejector device 140 for assisting in connection/disconnection of the ejector device 140 from the receptacle 210. As seen in FIG. 15, number of edges (Ne) is one more than number (Ns) of sidewalls (Ns) that is Ne=Ns+1. Further, at least one sidewall 146 includes a hole 147 for assisting in connection/disconnection of the ejector device 140 from the receptacle 210.

In another embodiment not shown in figures, the ejector device may not include sidewalls. Instead, the ejector device may just comprise an ejector plate and a plurality of raised projections extending from the ejector plate.

Referring to FIGS. 16-17, a method for pushing the bottom end 126 of each pre rolled cone 120 present/disposed in the receptacle 210 by using the ejector device 140 is shown. As seen, the receptacle 210 holds a plurality of pre rolled cones 120 (or the finished cones) wherein the top end 124 of each pre rolled cone 120 has already been closed using closure device 130 as described above. The receptacle 210 is moved relative to the ejector device 140 such that the ejector device 140 simultaneously pushes and at least partially ejects the bottom end 124 of the pre rolled cones 120 in a manner which will be described in greater detail in the description below.

Referring FIG. 16, firstly, the receptacle 210 is moved relative the ejector device 140 to align the bottom opening 218 (as can be seen in FIG. 4B and FIG. 5) of a plurality of through holes 216 with the plurality of raised projections 144.

Afterwards as shown in FIG. 17, the receptacle 210 is pushed/moved towards the ejector device 140 such that the plurality of raised projections 144 enters the bottom opening 218 (as can be seen in FIG. 4B and FIG. 5) of the through holes 216, thereby pushing the bottom end 126 of a plurality of pre rolled cones 120. The plurality of raised projections 144 enters the bottom opening 218 of plurality of through holes 216 due to a sliding movement between the plurality of sidewalls 146 and the second portion 114 of receptacle 210.

In an embodiment as shown in FIG. 17, the raised projection 144 of the ejector device 140 has an overall length less than the overall length of the through hole 216 of receptacle 210 to partially eject the pre rolled cones 120 out of the receptacle 210 holding the pre rolled cones 120 when the receptacle 210 is pushed against ejector device 140 (as seen in FIG. 16). Due to downward movement of the receptacle 210 such that the raised projections 144 of the ejector device 140 enters the through holes 216, the pre rolled cone 120 is moved vertically upside (as seen in FIG. 17), and a portion of pre rolled cone 120 extends/ejects outside top opening 217. Then, by simply inverting the receptacle 210 upside down, the finished pre rolled cones 120 are expelled out from the receptacle 210 using gravity optionally aided by shaking of the receptacle 210.

In another embodiment (not shown in figures), the raised projection 144 of the ejector device 140 has an overall length equal to or more than the overall length of the through holes 216 of the receptacle 210 to completely eject the pre rolled cones 120, when the receptacle 210 is pushed towards the ejector device 140.

A variety of methods for inserting the plurality of pre rolled cones 120 in the receptacle 110 will now be described.

In an embodiment, firstly, the plurality of pre rolled cones 120 are manually inserted by an operator one-by-one into the plurality of holes 116 of the receptacle 110 by using hands. Then afterwards, the pre rolled cones 120 inserted in the plurality of holes 116 are filled with intended smoking material through top end 124 using any conventionally known devices/methods already known in the prior art.

In another embodiment, the pre rolled cones 120 are first filled with the smoking material and then afterwards, the pre-filled pre rolled cones 120 are inserted one-by-one in the plurality of holes 116 using any conventionally known devices/methods already known in the prior art.

In another embodiment, a method of transferring the plurality of pre rolled cones 120 filled with the smoking material from a variety of filling machines/bases known in the art to the receptacle 110 will be describe d. The variety of filling machines/bases can include but not limited to manual pre rolled filling devices, electric vibrating pre rolled filling machines and so on.

Figure 18:
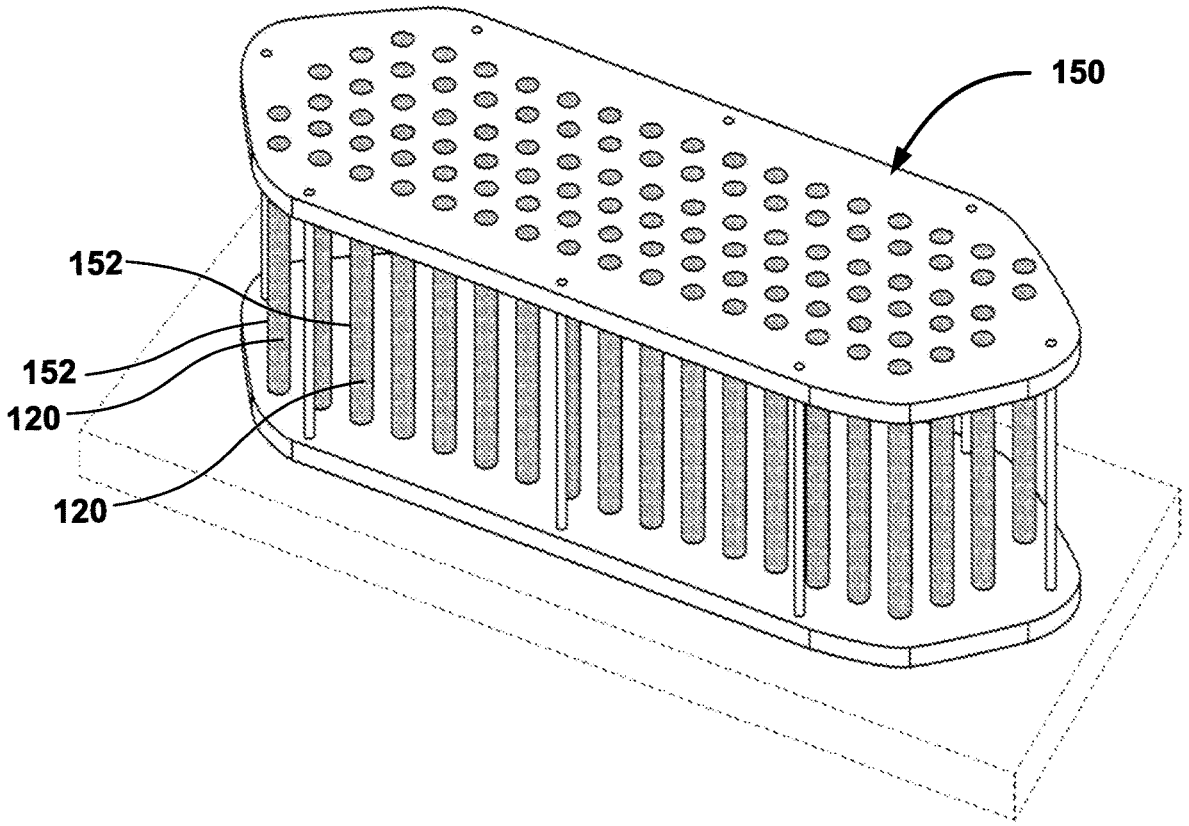
FIGS. 18-20 illustrates various steps of an exemplary method to transfer a plurality of pre rolled cones in the receptacle, according to an embodiment of the present invention.
Figure 19:
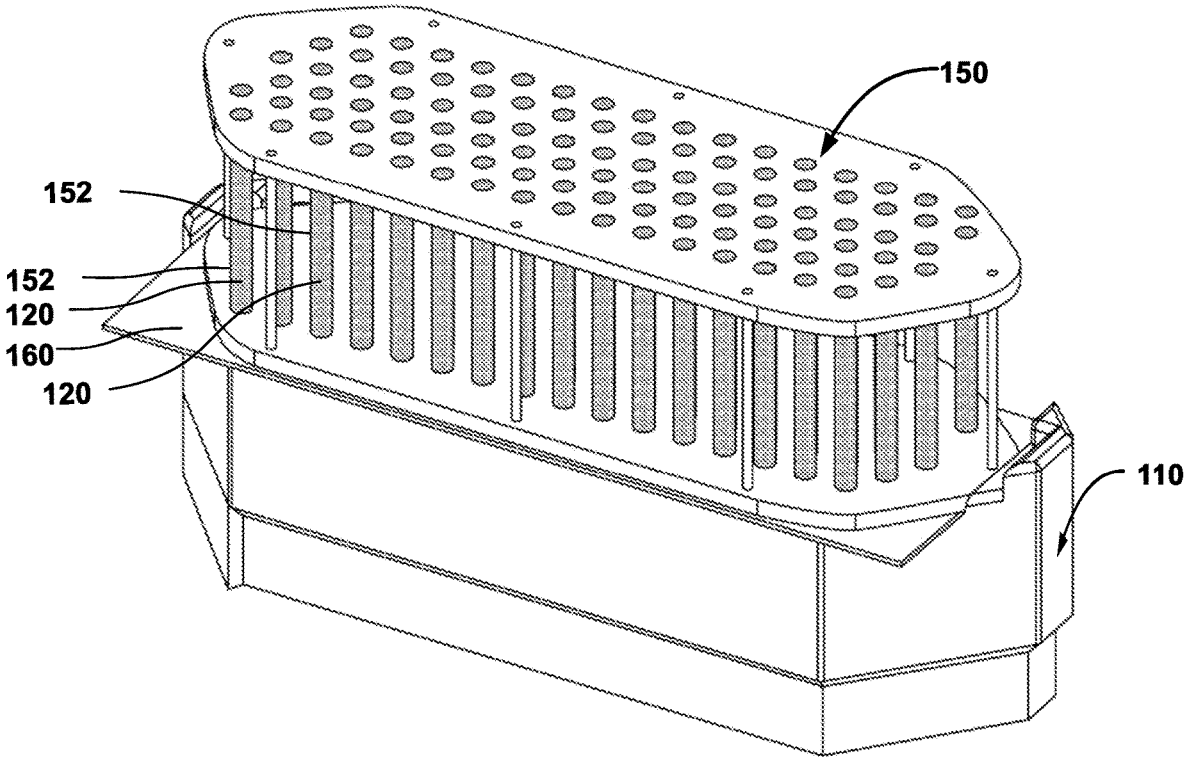
Figure 20:
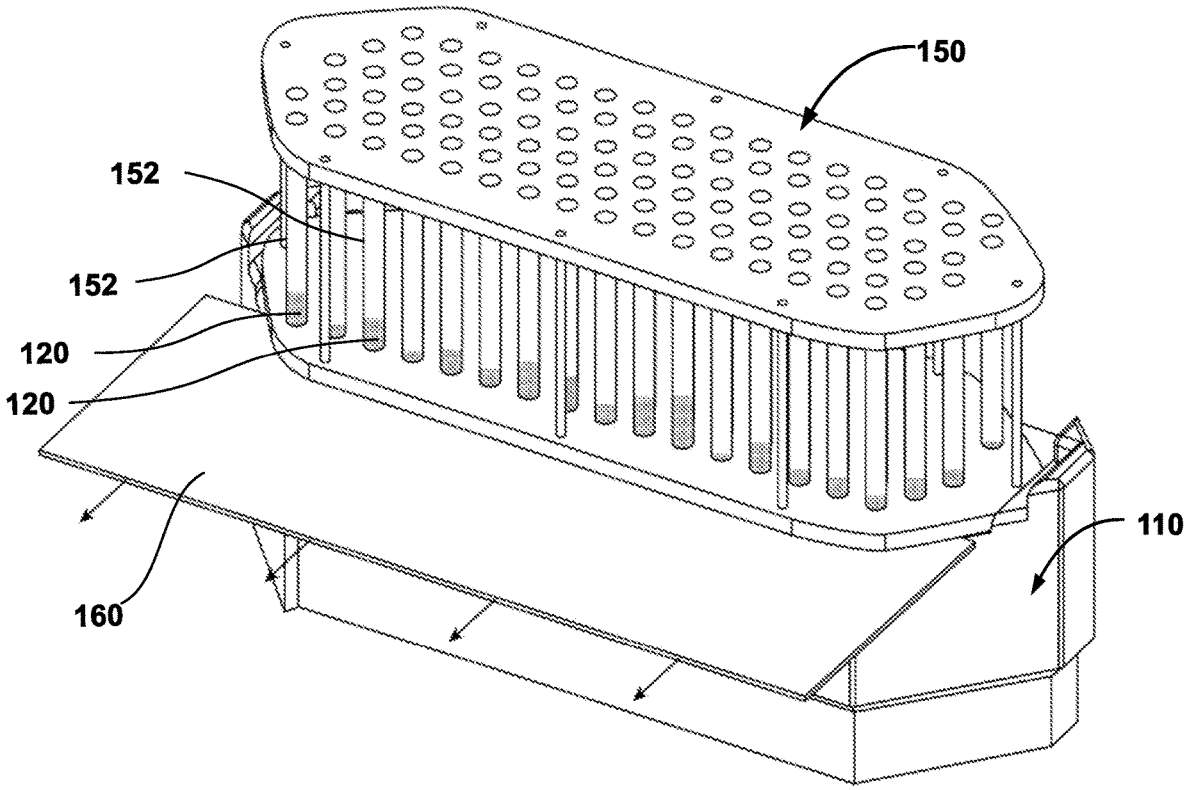

Referring to FIGS. 18-20 along with FIG. 3, a conventional prior art filling base 150 comprising of a plurality of tubes 152 disposed therein is shown. Each tube 152 of the filling base 150 is adapted to removably hold the pre rolled cones 120 filled with the smoking material. The filling of the smoking material in the tubes 152 of the filling base 150 could be accomplished using any conventional methods/devices such as but not limited to manual pre rolled filling devices, electric vibrating pre rolled filling machines and so on. The filling base 150 is arranged on the top of a cover plate 160 and the cover plate 160 is removably placed on the top of the receptacle 110 to cover the top opening 117 (as can be conferred from FIG. 3) of the plurality of holes 116. Then the cover plate 160 is slidably moved out from between the receptacle 110 and the filling base 150. The sliding out of the cover plate 160 ensures movement of the plurality of pre rolled cones 120 from the plurality of tubes 152 of the filling base 150 in the holes 116 of the receptacle 110 through the top opening 117 (as can be conferred from FIG. 3) under the effect of force of gravity and/or shaking motion of the filling base 150. Upon transfer of the pre rolled cones 120 into the receptacle 110, an extended portion 128 of length L of each pre rolled cone 120 projects outside the top opening 117 of each hole 116 as shown in FIG. 3. Afterwards, the empty filling base 150 and the cover plate 160 are moved away from the receptacle 110.

In various embodiments of the present invention, a variety of methods for inserting the plurality of pre rolled cones 120 in the receptacle 110 are described. However, it is obvious to the one skilled in the art that the plurality of pre rolled cones 120 can be inserted in the receptacle 210 using similar variety of methods with little or no variation.

It should be understood that the receptacle 110, the closure device 130, and the ejector device 140 may be constructed from substantially rigid materials selected from but not limited to metals, plastics, ceramics, wood and composites or any combinations thereof. Further, the receptacle 110, the closure device 130, and the ejector device 140 are made using conventional manufacturing processes such as but not limited to molding, machining, casting, 3D printing and so on.

According to various embodiments of the present invention, the movement of the various components e.g. the receptacle 110, the closure device 130, and the ejector device 140 is manually done by an operator using his/her hands. However, it should be understood that the movement of the various components e.g. the receptacle 110, the closure device 130, and the ejector device 140 could be enabled automatically using machines/machine platforms/robotic manipulators which would carry/transport the various components of the present invention for desired movement. The movement of various components using machines would allow automation of the smoking product making system as well as method and would be useful in mass production of plurality of smoking products.

In the embodiments described above it is seen that product making system 100 is being used to close and eject the pre rolled cones 120 having a substantially conical shape. However, it should be understood that rolling papers of other shapes known in the art, or varying sizes can be substituted for the pre rolled cones including but not limited to cylindrical shape, polygonal shape and so on.

In various embodiments of the present invention, a receptacle 110 comprising a plurality of holes 116 is considered for sake of simplicity. However, it is obvious to the one skilled in the art that the receptacle 210 comprising a plurality of through holes 216 could be considered for various embodiments of the present invention with little or no variation.

It should be understood according to the preceding description of the present invention that the same is susceptible to changes, modifications and adaptations, and that the said changes, modifications and adaptations fall within scope of the appended claims.

What is claimed is:

1. A smoking product making system for simultaneously producing a plurality of smoking products, the smoking product making system comprising:

a receptacle comprising a top surface, a bottom surface, and a plurality of tapered holes formed in the receptacle, the plurality of tapered holes extending through the top surface, forming top openings, and extending to the bottom surface and decreasing in diameter from the top surface to the bottom surface, the bottom surface having a plurality of bottom openings through the bottom surface corresponding to and coaxial with the plurality of tapered holes, wherein each of the plurality of tapered holes is configured to releasably hold a pre rolled cone at least partially filled with smoking material;

a closure device comprising a base plate and a plurality of raised projections extending from the base plate; and an ejector device having an ejector plate and a plurality of raised projections extending from the ejector plate, wherein the plurality of raised projections have a diameter smaller than the diameter of the plurality of bottom openings, wherein a set of predefined sequential movements of the closure device relative to the receptacle simultaneously closes a plurality of pre rolled cones held within the plurality of tapered holes, wherein during such sequential movements each raised projection of the closure device folds an extended portion of the plurality of pre rolled cones projecting outside the top opening of the plurality of tapered holes.

2. The smoking product making system of claim 1, wherein the plurality of tapered holes are formed in the receptacle in a pattern selected from circular pattern, array pattern, and linear pattern.

3. The smoking product making system of claim 1, further comprising a cover plate, wherein the plurality of pre rolled cones are transferred into the plurality of tapered holes of the receptacle using the cover plate.

4. The smoking product making system of claim 1, wherein the smoking product making system comprises a locking enclosure that is removably interlocked with the bottom surface of the receptacle.

5. The smoking product making system of claim 1, wherein each of the pre rolled cones comprises a top end and a bottom end.

6. The smoking product making system of claim 5, wherein the smoking material is selected from a group of material consisting of tobacco and marijuana.

7. The smoking product making system of claim 5, wherein the bottom end of each pre rolled cone includes a filter tip.

8. The smoking product making system of claim 1, wherein each of the plurality of pre rolled cones are substantially in a shape selected from conical shape, cylindrical shape, and polygonal shape.

9. The smoking product making system of claim 1, further comprising a pair of handles provided on the closure device to enable grasping by the hands of an operator for moving the closure device relative to the receptacle.

10. The smoking product making system of claim 1, wherein a length of the plurality of raised projections of the ejector device is shorter than a length of the plurality of tapered holes of the receptacle.

11. The smoking product making system of claim 1, wherein a length of the plurality of raised projections of the ejector device is equal to or longer than a the length of the plurality of tapered holes of the receptacle.

12. The smoking product making system of claim 1, wherein the ejector device further comprises a plurality of sidewalls extending from the peripheral edges of the ejector plate.

13. The smoking product making system of claim 12, wherein the number of sidewalls are less or equal to the number of edges of the ejector plate of the ejector device.

14. The smoking product making system of claim 12, wherein at least one sidewall includes a hole for assisting in connection/disconnection of the ejector device from the receptacle.

15. The smoking product making system of claim 1, wherein the sequential movement of the receptacle and/or the closure device is enabled manually by an operator.

16. The smoking product making system of claim 1, wherein the sequential movement of the receptacle and/or the closure device of the smoking product making system is enabled automatically by machines.

* * * * *